US009862017B2

(12) United States Patent
Higai et al.

(10) Patent No.: US 9,862,017 B2
(45) Date of Patent: Jan. 9, 2018

(54) METHOD AND APPARATUS THAT FORMS A CLOSED CROSS-SECTIONAL STRUCTURE

(71) Applicant: JFE Steel Corporation, Tokyo (JP)

(72) Inventors: Kazuhiko Higai, Chiba (JP); Toyohisa Shinmiya, Fukuyama (JP); Yuji Yamasaki, Fukuyama (JP)

(73) Assignee: JFE Steel Corporation (JP)

( * ) Notice: Subject to any disclaimer, the term of this patent is extended or adjusted under 35 U.S.C. 154(b) by 232 days.

(21) Appl. No.: 14/403,323

(22) PCT Filed: May 23, 2013

(86) PCT No.: PCT/JP2013/003285

§ 371 (c)(1),
(2) Date: Nov. 24, 2014

(87) PCT Pub. No.: WO2013/179618

PCT Pub. Date: Dec. 5, 2013

(65) Prior Publication Data

US 2015/0165511 A1 Jun. 18, 2015

(30) Foreign Application Priority Data

May 28, 2012 (JP) ..... 2012-120528

(51) Int. Cl.
*B21D 53/88* (2006.01)
*B21D 9/08* (2006.01)
(Continued)

(52) U.S. Cl.
CPC ..... *B21D 53/88* (2013.01); *B21D 5/015* (2013.01); *B21D 5/02* (2013.01); *B21D 9/08* (2013.01);
(Continued)

(58) Field of Classification Search
CPC ..... B21D 39/03; B21D 39/033; B21D 39/02; B21D 5/015; B21D 9/08; B21D 9/12;
(Continued)

(56) References Cited

U.S. PATENT DOCUMENTS 1,849,054 A * 3/1932 Boissou ..... B21D 5/015 72/471
4,238,550 A 12/1980 Burgess et al.
(Continued)

FOREIGN PATENT DOCUMENTS

DE 102005044423 A1 * 3/2007 ..... B21D 11/08
EP 2 351 624 8/2011
(Continued)

OTHER PUBLICATIONS

EPO Machine Translation of DE 10 2005 044423 A1.*
Supplementary European Search Report dated Jul. 30, 2015 of corresponding European Application No. 13797046.3.

*Primary Examiner* — R. K. Arundale
*Assistant Examiner* — Pradeep C Battula
(74) *Attorney, Agent, or Firm* — DLA Piper LLP (US)

(57) ABSTRACT

A workpiece is formed into a shape having curvatures in the longitudinal and width directions required for a final closed cross-sectional shape, and bend-facilitating lines are provided at positions corresponding to bent lines in the closed cross-sectional shape. The workpiece formed in the first step is bent in a direction that left and right side wall portions approach each other by clamping the bottom portions between a punch and pad in the plate thickness direction and by pressing a punch into a space between dies. A plug having an outer shape the same as the final closed cross-sectional shape is placed on the bottom portion of the workpiece formed in the second step, and the bottom portion and the left and right side wall portions are bent along the bend-
(Continued)

facilitating lines by pressing the bottom portion and the left and right side wall portions against a periphery of the plug.

6 Claims, 6 Drawing Sheets

(51) Int. Cl.

| | |
|---|---|
| ***B21D 39/02*** | (2006.01) |
| ***B21D 5/01*** | (2006.01) |
| ***B21D 5/02*** | (2006.01) |
| *B21D 26/033* | (2011.01) |
| *B21D 47/01* | (2006.01) |
| *B21D 11/08* | (2006.01) |

(52) U.S. Cl.
CPC ..... *B21D 39/02* (2013.01); *B21D 11/08* (2013.01); *B21D 26/033* (2013.01); *B21D 47/01* (2013.01)

(58) Field of Classification Search
CPC ..... B21D 11/02; B21D 11/08; B21D 11/085; B21D 11/10; B21D 11/20; B21D 53/88
USPC ..... 72/466.2, 466.8, 465.1, 381, 379.2
See application file for complete search history.

(56) References Cited

U.S. PATENT DOCUMENTS

| | | | | |
|---|---|---|---|---|
| 6,601,427 | B2 * | 8/2003 | Kondou | B21C 37/104 72/368 |
| 7,325,435 | B2 * | 2/2008 | Hamel | B21D 5/015 72/368 |
| 8,365,411 | B2 * | 2/2013 | Saito | B21D 5/015 29/897.2 |
| 8,505,352 | B2 * | 8/2013 | Flehmig | B21D 5/015 72/352 |
| 8,844,581 | B2 * | 9/2014 | Higai | B21D 39/02 138/170 |
| 9,162,272 | B2 * | 10/2015 | Higai | B21D 39/03 |
| 2004/0035166 | A1 * | 2/2004 | Maeda | B21D 5/015 72/48 |
| 2010/0218375 | A1 * | 9/2010 | Saito | B21D 5/015 29/897.2 |
| 2011/0174868 | A1 | 7/2011 | Higai et al. | |
| 2012/0204993 | A1 | 8/2012 | Higai et al. | |

FOREIGN PATENT DOCUMENTS

| | | |
|---|---|---|
| JP | 57-165120 | 10/1982 |
| JP | 59-82126 | 5/1984 |
| JP | 2006-116552 | 5/2006 |
| JP | 2010-75946 | 4/2010 |
| JP | 2010-247225 | 11/2010 |
| JP | 2010-284668 | 12/2010 |
| KR | 10-2010-0004216 | 10/2010 |
| WO | 2011/034203 | 3/2011 |

* cited by examiner

BEND-FACILITATING LINE PRESENT AND PLUG NOT USED

BEND-FACILITATING LINE ABSENT AND PLUG USED

METHOD AND APPARATUS THAT FORMS A CLOSED CROSS-SECTIONAL STRUCTURE

CROSS-SECTIONAL STRUCTURE

Technical Field

This disclosure relates to a method and an apparatus that forms a plate-shaped workpiece into a closed cross-sectional structure.

Background

To date, for example, a technology described in Japanese Unexamined Patent Application Publication No. 2006-116552 is known as a method of manufacturing a part having a closed cross section.

Japanese Unexamined Patent Application Publication No. 2006-116552, the following steps are successively performed: a step of making a semifinished part by press-forming a metal plate so that a pair of half portions of a closed cross-sectional structure extend upwardly from ends of a connecting part having a flat cross section; a step of making the half portions of the closed cross-sectional structure extend further upwardly while forming the connecting part into a bent part having a V-shaped cross section by pressing the connecting part from the inside by using a flat punch inserted into a space between the pair of half portions of the closed cross-sectional structure; and a step of causing outer ends of the half portions of the closed cross-sectional structure to be butted against each other and welding the outer ends after withdrawing the flat punch from the space between the pair of half portions of the closed cross-sectional structure.

Japanese Unexamined Patent Application Publication No. 2006-116552 discloses methods of forming structures having closed cross sections that are circular, rectangular, pentagonal, and polygonal. With that approach, a flat punch having a protrusion at an end thereof is inserted into a space between the pair of half portions of a closed cross-sectional structure, and the half portions of the closed cross-sectional structure is made to extend further upwardly while forming the connecting part into a bent part having a V-shaped cross section by pressing the connecting part from the inside using the flat punch.

Thus, it is necessary to form the bent part having a V-shaped cross section when making the half portions of the closed cross-sectional structure extend upwardly. Because the V-shaped bent part is formed by bending the connecting part into a shape having a comparatively small radius (radius of curvature), a crack may be generated at the V-shaped bent part when a material having a low ductility such as a high-tensile strength steel, is used. Moreover, a crack not visible to the naked eye is likely to be generated and a fracture is likely to occur.

Therefore, the method described in Japanese Unexamined Patent Application Publication No. 2006-116552 has a problem related to formability when the method is used to form a structural part of an automobile such as a front side member. If the end of the V-shaped bent part had a round shape, the half portions of the closed cross-sectional structure would extend upwardly to a smaller degree, and therefore it would become difficult to perform welding in the next step.

Moreover, to form a closed cross-sectional structure having curvatures in three-dimensional directions by using the method described in Japanese Unexamined Patent Application Publication No. 2006-116552, it is necessary to form the three-dimensionally curved shapes in the pair of half portions of the closed cross-sectional structure and to form flange portions at ends of the pair of half portions of the closed cross-sectional structure in the width direction with high precision. Accordingly, that method has a problem related to the production cost.

It could therefore be helpful to provide a method and an apparatus that forms a closed cross-sectional structure and having a three-dimensionally curved shape. By using the method and the apparatus, structures used as structural parts of an automobile or the like can be formed with high precision and can be manufactured at a reduced production cost.

SUMMARY

We thus provide:

[1] A method of forming a closed cross-sectional structure by bending a plate-shaped workpiece at positions that to be a plurality of bent lines extending in a longitudinal direction, the structure including a bottom portion formed in a central part of the workpiece in a width direction and left and right side wall portions located on both sides of the bottom portion in the width direction.

The method includes:

a first step of press-forming the workpiece into a curved shape that has curvatures in the longitudinal direction and in the width direction required for a final closed cross-sectional shape, and of providing bend-facilitating lines at positions that to be the bent lines in the final closed cross-sectional shape;

a second step of bending the workpiece, which has been formed in the first step, in such a direction that the left and right side wall portions approach each other by pressing the punch into a space between a pair of dies while clamping the bottom portion between the punch and a pad in a plate-thickness direction and; and a third step of bending the bottom portion and the left and right side wall portions along the bend-facilitating lines by pressing the bottom portion and the left and right side wall portions against an outer periphery of a plug having an outer peripheral shape that is the same as the final closed cross-sectional shape while the plug is placed on the bottom portion of the workpiece, which has been formed in the second step.

[2] In the method of forming the closed cross-sectional structure described in [1], in the third step, the plug is placed on an end portion in the longitudinal direction of the bottom portion of the workpiece.

[3] In the method of forming the closed cross-sectional structure described in [1] or [2], the bend-facilitating lines are provided so that the bottom portion and the left and right side wall portions have curvatures.

[4] In the method of forming the closed cross-sectional structure described in any one of [1] to [3], each of the bend-facilitating lines is a portion of the workpiece where a groove is formed in one surface thereof and a protrusion corresponding to the groove is formed on the other surface thereof, wherein a depth of the groove is greater than or equal to 0.05 times and less than or equal to 0.3 times a plate thickness and wherein a width of the groove is greater than or equal to 0.2 mm and less than or equal to 3.0 mm.

[5] An apparatus that forms a closed cross-sectional structure by bending a plate-shaped workpiece at positions that to be a plurality of bent lines extending in a longitudinal direction, the structure including a bottom portion formed in a central part of the workpiece in a width direction and left and right side wall portions located on both sides of the bottom portion in the width direction.

The apparatus includes:

a pressing die including an upper die and a lower die for press-forming the workpiece into a curved shape that has curvatures in the longitudinal direction and in the width direction required for a final closed cross-sectional shape, and for providing bend-facilitating lines at positions that to be the bent lines in the final closed cross-sectional shape;

a bending die for bending the workpiece, which has been formed using the pressing die, in such a direction that the left and right side wall portions approach each other by pressing the punch into a space between a pair of dies while clamping the bottom portion between the punch and a pad in a plate-thickness direction and; and a final-closed-cross section bending die including a plug, a pair of pressure cams and a supporting pad, the plug having an outer peripheral shape that is the same as the final closed cross-sectional shape and disposed on the bottom portion of the workpiece, which has been formed using the bending die, the support pad supporting the bottom portion of the workpiece, the pair of pressure cams being disposed outside of the support pad and the plug in the width direction, the final-closed-cross section die bending the bottom portion and the left and right side wall portions along the bend-facilitating lines by pressing the bottom portion and the left and right side wall portions against an outer periphery of the plug using the support pad and the pair of pressure cams.

The method of forming a closed cross-sectional structure described in [1], includes a third step of bending the bottom portion and the left and right side wall portions along the bend-facilitating lines by pressing the bottom portion and the left and right side wall portions against an outer periphery of a plug having an outer peripheral shape that is the same as the final closed cross-sectional shape while the plug is placed on the bottom portion of the workpiece. Therefore, a closed cross-sectional structure can be easily formed with high precision and at a reduced cost.

With the method of forming a closed cross-sectional structure described in [2], the plug can be easily removed from a workpiece that has been formed into the final closed cross-sectional shape in the third step.

With the method of forming a closed cross-sectional structure described in [3], a closed cross-sectional structure having a predetermined three-dimensionally curved shape can be formed with high precision.

With cross-sectional structure described in [4], each of the bend-facilitating lines formed along boundaries between the bottom portion and the left and right side wall portions is a portion of the workpiece in which a groove is formed to have a depth that is greater than or equal to 0.05 times and less than or equal to 0.3 times a plate thickness T and a width that is greater than or equal to 0.2 mm and less than or equal to 3.0 mm. Therefore, in the third step, the bottom portion and the left and right side wall portions can be bent along the bend-facilitating lines with high precision.

With the apparatus that forms a closed cross-sectional structure described in [5], a closed cross-sectional structure having predetermined shape can be easily formed, and the production cost can be considerably reduced.

REFERENCE SIGNS LIST

Figure 1:
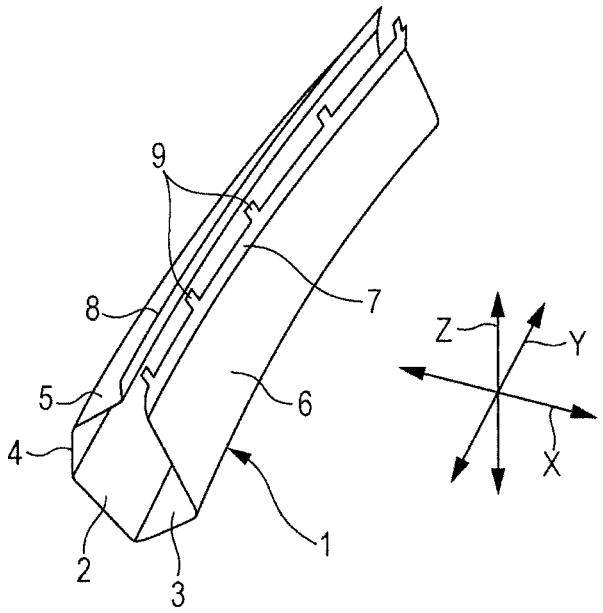
FIG. 1 is a perspective view of a closed cross-sectional structure formed by using our forming method.

1 workpiece
2, 3 bottom portion
4, 5 left side wall portion
6 right side wall portion
7, 8 flange portion
9 hemming prong
10 upper die
11 lower die
12 groove
13 protrusion
15 first punch
16 pad
17 die
20 plug
21 second punch
22 support pad
23, 24 pressure cam
25 hydraulic actuator
26 cam driving mechanism
27 slit clearance
28 insert guide surface
B1 to B6 bend line
G bend-facilitating line
H groove width
T plate thickness

DETAILED DESCRIPTION

Hereinafter, will be described with reference to the drawings.

FIG. 1 illustrates the shape of a workpiece 1 in the process of being formed into a closed cross-sectional structure having an irregularly pentagonal cross-sectional shape. The workpiece 1 includes bottom portions 2 and 3 which form two sides of the irregularly pentagonal shape; left side wall portions 4 and 5, which form two sides of the irregularly pentagonal shape; a right side wall portion 6 which forms the remaining side of the irregularly pentagonal shape; and a pair of flange portions 7 and 8. The flange portions 7 and 8 are formed to be continuous with the right side wall portion 6 and the left side wall portion 5, which are butted against each other. The workpiece 1 extends in the longitudinal direction.

A plurality of hemming prongs 9 are arranged along an edge of the flange portion 7 at predetermined intervals in the longitudinal direction.

The bottom portions 2 and 3, the left side wall portions 4 and 5, the right side wall portion 6, and the flange portions 7 and 8 are each formed to have curvatures in the Y-axis direction, in the X-axis direction, and in the Z-axis direction (to have a three-dimensionally curved shape) in a three-dimensional coordinate system. In this coordinate system, the Y-axis extends in the longitudinal direction, the X-axis extends in the width direction, and the Z-axis extends in a direction perpendicular to a surface including the Y-axis and the X-axis.

Structure of Apparatus

An apparatus that forms a closed cross-sectional structure includes a workpiece pressing die, a bending die, and a hemming press apparatus (final-closed-cross section bending die).

Figure 2:
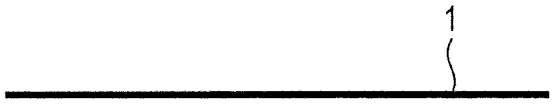
FIGS. 2(*a*)-(*c*) schematically illustrate the process of a first step and the devices used in the first step.
Figure 2:
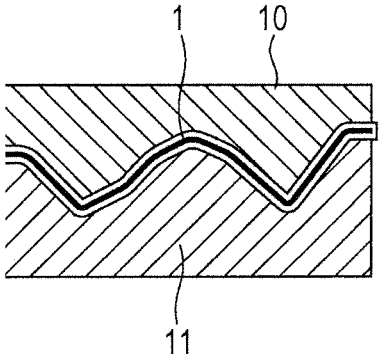
Figure 2:
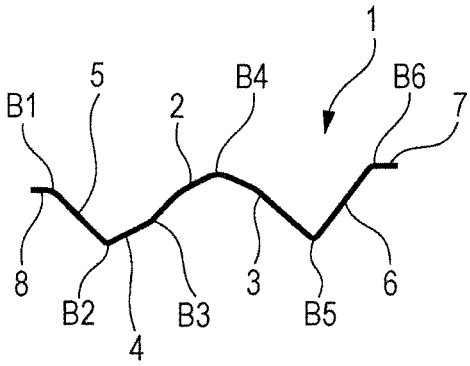

FIG. 2(*b*) illustrates the workpiece pressing die which includes an upper die 10 and a lower die 11.

A press-forming surface of the upper die 10, which faces in a downward direction, and a press-forming surface of the lower die 11, which faces in an upward direction, have shapes that correspond to each other. A press-forming operation is performed by placing the plate-shaped workpiece 1 shown in FIG. 2(*a*) between the press-forming surface of the upper die 10 and the press-forming surface of the lower die 11 and by pressing the upper die 10 against the lower die 11.

As illustrated in FIG. 2(*c*), the workpiece 1, which has been press-formed using the workpiece pressing die, has the bottom portions 2 and 3 located at substantially a central part thereof in a width direction, the left side wall portions 4 and 5 located on a side of the bottom portion 2 in the width direction, the right side wall portion 6 located on a side of the bottom portion 3 in the width direction, the flange portion 8 located at an end of the left side wall portion 5 in the width direction, and the flange portion 7 (which has the hemming prongs 9) located at an end of the right side wall portion 6 in the width direction. Line length adjustment is performed by forming bend lines B1 to B6 extending in the longitudinal direction along boundaries between the portions 2 to 8.

Figure 3:
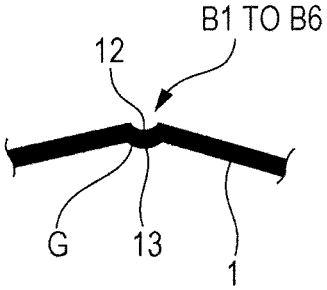
FIGS. 3(*a*) and (*b*) illustrate the structure of a bend-facilitating line formed in a workpiece in the first step.
Figure 3:
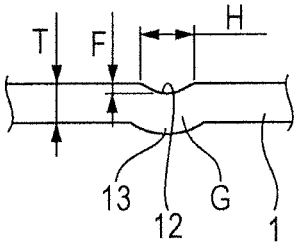

As illustrated in FIG. 3(*a*), at each of the bend lines B1 to B6, a bend-facilitating line G extending in the longitudinal direction is formed at a position corresponding to a bent line in the final closed-sectional shape. The bend-facilitating line G is a portion protruded in a substantially U-shape where a groove 12 is formed in one surface at a position corresponding to each of the bend lines B1 to B6 and a protrusion 13 is formed on the other surface opposite to the groove 12.

As illustrated in FIG. 3(*b*), the bend-facilitating line G is formed so that the depth F of the groove 12 is greater than or equal to 0.05 times and less than or equal to 0.3 times the plate thickness T of the workpiece 1 and the groove width H of the groove 12 is greater than or equal to 0.2 mm and less than or equal to 3.0 mm.

The bend-facilitating line G, which protrudes in a substantially U-shape in this example, may protrude in a substantially V-shape.

Figure 4:
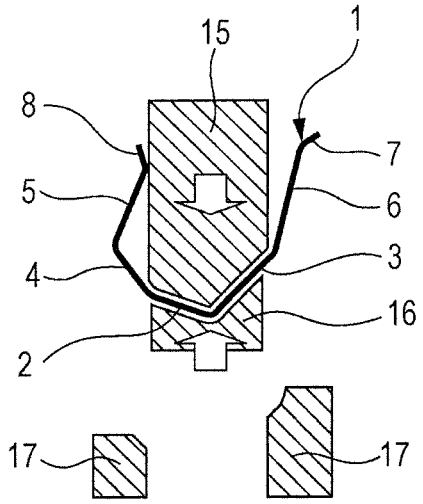
FIGS. 4(*a*) and (*b*) schematically illustrate the process of a second step and the devices used in the second step.
Figure 4:
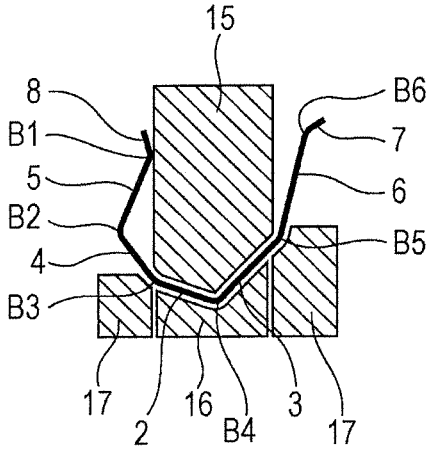

FIG. 4(*a*) illustrates the bending die which includes a first punch 15, a pad 16, and a pair of dies 17.

The cross-sectional shape of a pressing portion of the first punch 15, that is, the cross-sectional shape of a lower end portion is the same as that of the bottom portions 2 and 3 of the closed cross-sectional structure.

The pad 16 faces the first punch 15 in the vertical direction. An upper surface of the pad 16 has the same shape as the cross-sectional shape of a lower end portion of the first punch 15. As illustrated in FIG. 4(*a*), the bottom portions 2 and 3 of the workpiece 1, which has been press-formed using the workpiece pressing die, are clamped between the first punch 15 and the pad 16 in the plate-thickness direction.

The pair of dies 17 face each other with a distance, corresponding to the width of the bottom portions 2 and 3, therebetween.

As illustrated in FIG. 4(*b*), by pressing the workpiece 1, which is clamped between the first punch 15 and the pad 16, into a space between the pair of dies 17, the workpiece 1 is bent along the bend line B4 in a direction that the left side wall portions 4 and 5 and the right side wall portion 6 approach each other.

Figure 5:
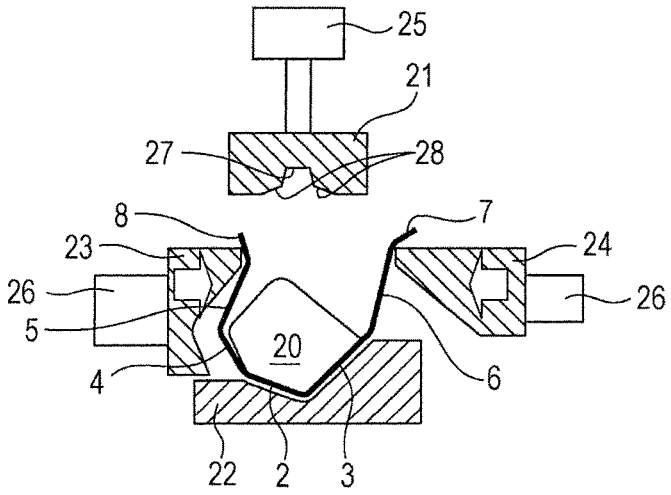
FIGS. 5(*a*)-(*c*) schematically illustrate the process of a third step and the devices used in the third step.
Figure 5:
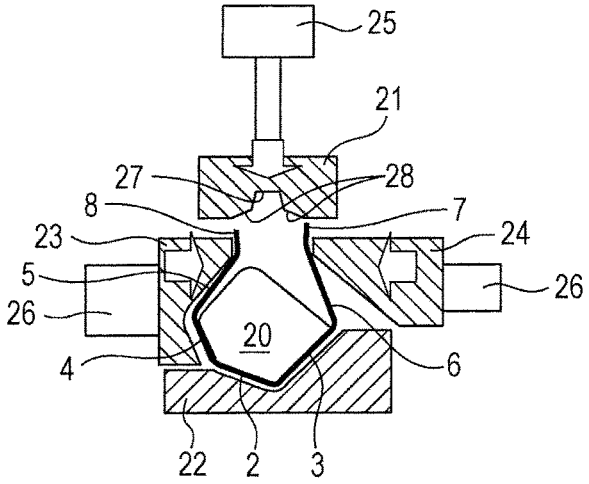
Figure 5:
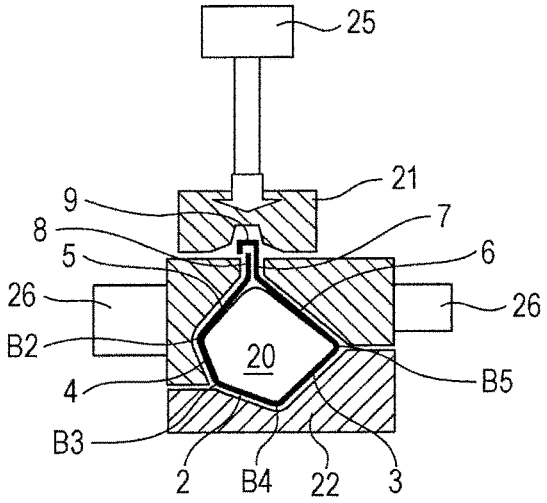

FIG. 5(*a*) illustrates the hemming press apparatus, which includes a plug 20 having an outer peripheral shape that is the same as that of the closed cross-sectional structure (final closed cross-sectional shape), a second punch 21 disposed above the plug 20, a support pad 22 disposed below the plug 20, and a pair of pressure cams 23 and 24 disposed outside of the plug 20 in the width direction.

Figure 6:
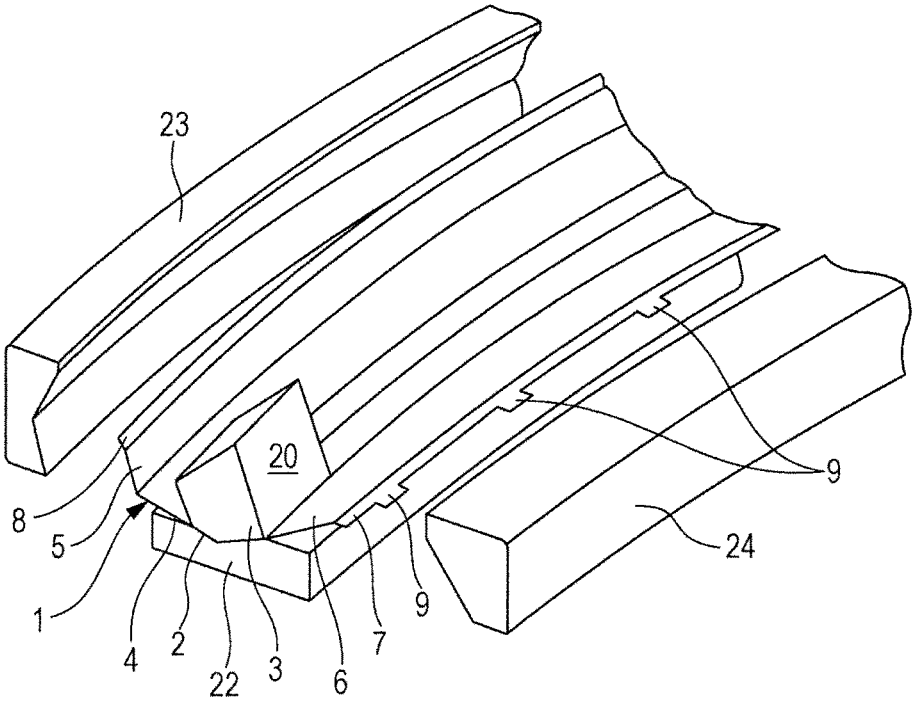
FIG. 6 illustrates a plug used in the third step.

As illustrated in FIG. 6, the plug 20 is a short member disposed at an end portion of the workpiece 1, which has been bent using the bending die, in the longitudinal direction. In addition to the plug 20 shown in FIG. 6, which is disposed at one end portion of the workpiece 1 in the longitudinal direction, another plug 20 is disposed at the other end portion of the workpiece 1.

The second punch 21 is a long member having substantially the same length as that of the workpiece 1 in the longitudinal direction. The second punch 21 is moved by a hydraulic actuator 25 in the vertical direction. The pair of pressure cams 23 and 24 are each a long member having substantially the same length as that of the workpiece 1 in the longitudinal direction. Cam driving mechanisms 26, which move in accordance with the operation of the hydraulic actuator 25, connect to the pair of pressure cams 23 and 24. The cam driving mechanisms 26 move the pair of pressure cams 23 and 24 to pressing positions located adjacent to the plug 20 or to standby positions located away from the plug 20.

The support pad 22 is a long member having substantially the same length as that of the workpiece 1 in the longitudinal direction. An upper surface of the support pad 22 has a three-dimensionally curved shape that is the same as that of the bottom portions 2 and 3 of the closed cross-sectional structure.

A pressing surface of the pressure cam 23 facing the plug 20 has a three-dimensionally curved shape that is the same as that of the left side wall portions 4 and 5 of the closed cross-sectional structure.

A pressing surface of the pressure cam 24 facing the plug 20 has a three-dimensionally curved shape that is the same as that of the right side wall portion 6 of the closed cross-sectional structure.

A slit clearance 27 is formed at the center of a lower end surface of the second punch 21 in the width direction. Insert guide surfaces 28 are formed on peripheries of an opening of the slit clearance 27.

A final-closed-cross section bending die corresponds to the plug 20, the support pad 22, and the pair of pressure cams 23 and 24. A punch used in the second step or a punch of the bending die corresponds to the first punch 15.

Method of Forming a Closed Cross-Sectional Structure

Next, a method of forming a closed cross-sectional structure by using the workpiece pressing die, the bending die, and the closed-cross-section/hemming press apparatus having the aforementioned constructions will be described.

First Step

As illustrated in FIG. 2(*b*), the plate-shaped workpiece 1 shown in FIG. 2(*a*) is placed between the press-forming surfaces of the upper die 10 and the lower die 11, and a press-forming operation is performed by pressing the upper die 10 against the lower die 11.

As illustrated in FIG. 2(*c*), due to the press-forming operation, the bottom portions 2 and 3 are formed at substantially the central part of the workpiece 1 in the width direction, the left side wall portions 4 and 5 are formed on a side of the bottom portion 2 in the width direction, the right side wall portion 6 is formed on a side of the bottom portion 3 in the width direction, the flange portion 8 is formed at an end of on the left side wall portion 5 in the width direction, and the flange portion 7 (which has the hemming prongs 9) is formed at an end of the right side wall portion 6 in the width direction. Bend lines B1 to B6 extending in the longitudinal direction are formed along boundaries between the portions 2 to 8. At each of the bend lines B1 to B6, the bend-facilitating line G extending in the longitudinal direction is formed at a position corresponding to a bent line in the final closed-sectional shape.

Second Step

Next, as illustrated in FIG. 4(*a*), the bottom portions 2 and 3 of the workpiece 1, which has been press-formed as described above, are clamped between the first punch 15 and the pad 16. Then, while the bottom portions 2 and 3 are clamped between the first punch 15 and the pad 16, the first punch 15 is inserted into a space between the pair of dies 17 to the bottom dead center.

As illustrated in FIG. 4(*b*), by pressing the workpiece 1, which is clamped between the first punch 15 and the pad 16, into the space between the pair of dies 17, the workpiece 1 is bent along the bend line B4 in a direction that the left side wall portions 4 and 5 and the right side wall portion 6 approach each other.

Third Step

Next, the plugs 20 are placed at both end portions in the longitudinal direction of the workpiece 1. As illustrated in FIG. 5(*a*), the bottom portions 2 and 3 of the workpiece 1, both end portions in the longitudinal direction thereof are disposed with the plugs 20, are placed on the support surface of the support pad 22. At this time, the pressing surfaces of the pair of pressure cams 23 and 24, which are located at the standby positions, contact outer peripheries of the left side wall portion 5 and the right side wall portion 6 of the workpiece 1.

Next, as illustrated in FIG. 5(*b*), the hydraulic actuator 25 is operated to move the second punch 21 downwardly. In accordance with the operation of the hydraulic actuator 25, the cam driving mechanisms 26 move the pair of pressure cams 23 and 24 from the standby positions toward the pressing surfaces. Thus, the left side wall portion 5 and the right side wall portion 6 of the workpiece 1, which are pressed by the pressing surfaces of the pair of pressure cams 23 and 24, approach each other.

Next, as illustrated in FIG. 5(*c*), when the hydraulic actuator 25 is operated, the second punch 21 is lowered and the cam driving mechanisms 26 move the pair of pressure cams 23 and 24 to the pressing positions. Then, the pair of pressure cams 23 and 24 and the support pad 22 press the bottom portions 2 and 3, the left side wall portions 4 and 5, and the right side wall portion 6 of the workpiece 1 against the outer periphery of the plug 20. As a result, the bottom portions 2 and 3, the left side wall portions 4 and 5, and the right side wall portion 6 are bent along the bend-facilitating lines G at the bend lines B2 to B5 to have predetermined three-dimensionally curved shape.

The pair of flange portions 7 and 8 become closed when the bottom portions 2 and 3, the left side wall portions 4 and 5, and the right side wall portion 6 of the workpiece 1 are pressed against the outer periphery of the plug 20. As a result, the bottom portions 2 and 3, the left side wall portions 4 and 5, and the right side wall portion 6 form a structure having a cross-sectional shape that is the same as the final closed cross-sectional shape.

When the hydraulic actuator 25 is driven to lower the second punch 21 to the lowest position, ends of the pair of flange portions 7 and 8 of the workpiece 1 move along the insert guide surfaces 28 of the second punch 21 toward the slit clearance 27.

Figure 7:
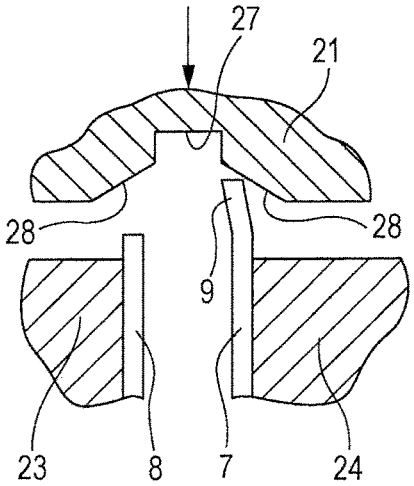
FIGS. 7(*a*) and (*b*) illustrate a hemming press operation performed in the third step.
Figure 7:
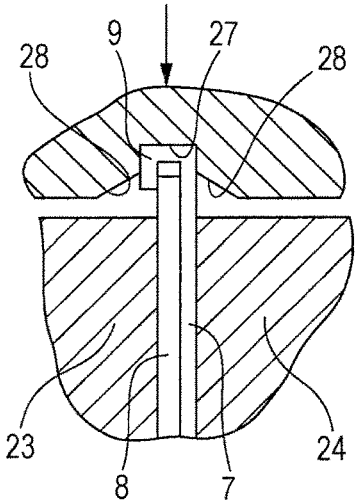

At this time, as illustrated in FIG. 7(*a*), when the plurality of hemming prongs 9, which are arranged along the edge of the flange portion 7, contact one of the insert guide surfaces, ends of the hemming prongs 9 become deformed toward the slit clearance 27. Then, as illustrated in FIG. 7(*b*), as the second punch 21 lowers, a downward pressing force is applied from the inner surface of the slit clearance 27 to the hemming prongs 9. Therefore, the hemming prongs 9 are bent downwardly along lines near the boundaries between the flange portion 7 and the hemming prongs 9, and the hemming prongs 9 clamp end portions of the flange portion 8. Thus, the flange portion 7 is joined (joined by a hemming joint) to the flange portion 8 via the plurality of hemming prongs 9. The hemming portion may also be welded, for example, as necessary.

Operational Effects

As described above, the first step is performed to adjust the line length by forming respective bend lines extending in the longitudinal direction B2 to B5 at least along boundaries between the bottom portions 2 and 3 and the left and right side wall portions 4, 5, and 6 of the plate-shaped workpiece 1 and to provide bend-facilitating lines G at positions of the bottom portions 2 and 3 and the left and right side wall portions 4, 5, and 6 corresponding to bent lines in the final closed cross-sectional shape. Next, the second step is performed to bend the workpiece 1 along the bend line B4 in a direction that the left side wall portions 4 and 5 and the right side wall portion 6 approach each other. Subsequently, the plug 20, having an outer peripheral shape that is the same as the final closed cross-sectional shape, is disposed at an end portion in the longitudinal direction of the workpiece 1, which has been formed in the second step, and the bottom portions 2 and 3 and the left and right side wall portions 4, 5, and 6 are bent along the bend-facilitating lines G by pressing the bottom portions 2 and 3 and the left and right side wall portions 4, 5, and 6 against the outer periphery of the plug 20. As a result, the bottom portions 2 and 3 and the left and right side wall portions 4, 5, and 6 of the closed cross-sectional structure can be easily formed with high precision.

In the third step, the plug 20, which has an outer peripheral shape the same as the final closed cross-sectional shape, is disposed at an end portion of the workpiece 1 in the longitudinal direction and, while pressing the bottom portions 2 and 3 and the left and right side wall portions 4, 5, and 6 against the outer periphery of the plug 20, the bottom portions 2 and 3 and the left and right side wall portions 4, 5, and 6 are bent along the bend-facilitating lines G, which will become the bent lines in the final closed cross-sectional shape. Therefore, a closed cross-sectional structure having a predetermined three-dimensionally curved shape can be formed with high precision.

Moreover, because the plug 20 is disposed at an end portion in the longitudinal direction of the workpiece 1, the plug 20 can be easily removed even after the closed cross-sectional structure has been formed.

As illustrated in FIG. 3(*b*), the bend-facilitating lines G formed along the boundaries between the bottom portions 2 and 3, the left side wall portions 4 and 5, the right side wall portion 6, and the pair of flange portions 7 and 8 in the first step, are each configured so that the depth F of the groove 12 is greater than or equal to 0.05 times and less than or equal to 0.3 times the plate thickness T of the workpiece 1, and the groove width H of the groove 12 is greater than or equal to 0.2 mm and less than or equal to 3.0 mm.

If the depth F of the groove 12 of the bend-facilitating line G were less than 0.05 times the plate thickness T of the workpiece 1, the depth F of the groove 12 would be too small so that the bottom portions 2 and 3 and the left and right side wall portions 4, 5, and 6 might not be bent along the bend-facilitating lines G in the third step. On the other hand, if the depth F of the groove 12 were greater than 0.3 times the plate thickness T of the workpiece 1, the depth F of the groove 12 would too large, so that, depending on the material, a crack might be generated along the bend-facilitating lines G in the third step.

If the groove width H of the groove 12 were less than 0.2 mm, the groove width H would too small so that the bottom portions 2 and 3 and the left and right side wall portions 4, 5, and 6 might not be bent along the bend-facilitating lines G in the third step. On the other hand, if the groove width H of the groove 12 were greater than 3.0 mm, the groove width H would too large, so that, depending on the material, a crack might be generated along the bend-facilitating lines G in the third step.

Accordingly, by configuring each of the bend-facilitating lines G formed along the boundaries of the bottom portions 2 and 3, the left side wall portions 4 and 5, the right side wall portion 6, and the pair of flange portions 7 and 8 so that the depth F of the groove 12 is greater than or equal to 0.05 times and less than or equal to 0.3 times the plate thickness T of the workpiece 1 and the groove width H of the groove 12 is greater than or equal to 0.2 mm and less than or equal to 3.0 mm, the bottom portions 2 and 3 and the left and right side wall portions 4, 5, and 6 can be bent along the bend-facilitating lines G with high precision in the third step.

Thus, by using the forming method, an integrally formed part in which a flange portion is minimized for weight reduction and which is used in the fields of automobile industry, home electronics industry, and other fields, can be easily manufactured. Moreover, a part having a curved surface on a side thereof can be formed with high precision.

Note that the method, which is a method of forming the plate-shaped workpiece 1 into a closed cross-sectional structure, can be used not only to form a structure having the aforementioned cross-sectional shape but also to form structures having various other cross-sectional shapes.

Example

An example and comparative examples will be shown to demonstrate the desired effects. Workpieces used in the example and the comparative examples were made of a material having the following properties.

used steel sheet: 980 MPa grade cold-rolled steel sheet
plate thickness: 1.6 mm
tensile strength: 1005 MPa
yield strength: 680 MPa
total elongation: 17%

The above tensile properties were measured in accordance with JIS Z 2241 by using a JIS No. 5 test piece sampled from a direction perpendicular to the rolling direction.

Figure 8:
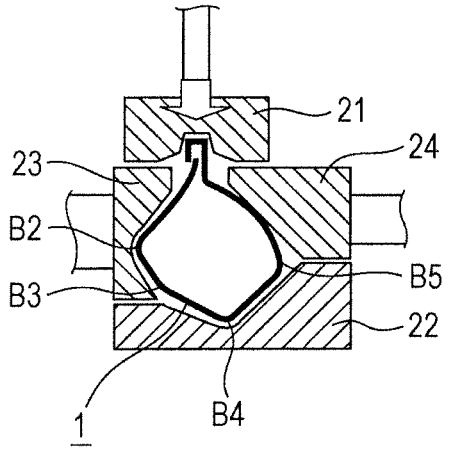
FIG. 8 illustrates a first comparative example compared to one of our examples.

FIG. 8 illustrates a comparative example 1 in which a closed cross-sectional structure was formed as follows: in the first step, the bend lines B2 to B5 of the bottom portions 2 and 3 and the left and right side wall portions 4, 5, and 6 were provided with the bend-facilitating lines G at positions corresponding to bent lines in the final closed cross-sectional shape; but, in the third step, the bottom portions 2 and 3 and the left and right side wall portions 4, 5, and 6 were bent and the pair of flange portions 7 and 8 were fixed without using a plug.

In comparative example 1, the forming operations in the first step and the second step could be performed, but the forming operation in the third step could not be performed. In other words, because the closed cross-sectional structure shown in FIG. 8 was formed without using a member (the plug 20) to support the bottom portions 2 and 3 and the left and right side wall portions 4, 5, and 6 from the inside, the bottom portions 2 and 3 and the left and right side wall portions 4, 5, and 6 were not bent along the bend-facilitating lines G. As a result, the closed cross-sectional structure having a three-dimensionally curved shape could not be formed with high precision.

Figure 9:
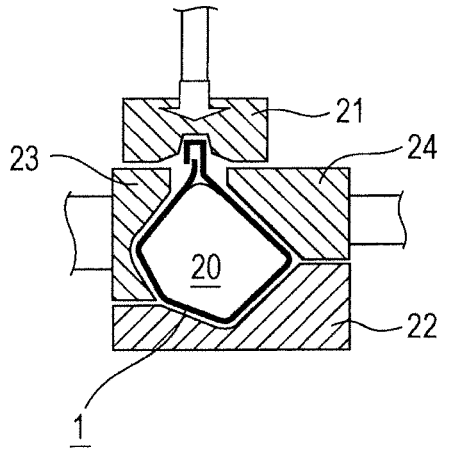
FIG. 9 illustrates a second comparative example compared to one of our examples.

FIG. 9 illustrates a comparative example 2 in which a closed cross-sectional structure was formed as follows: in the first step, the bend lines B2 to B5 of the bottom portions 2 and 3 and the left and right side wall portions 4, 5, and 6 were not provided with the bend-facilitating lines G; and, in the third step, the bottom portions 2 and 3 and the left and right side wall portions 4, 5, and 6 were bent and the pair of flange portions 7 and 8 are fixed by using the plug 20.

In comparative example 2, the forming operations in the first step and the second step could be performed, but the forming operation in the third step could not be performed. In other words, because the closed cross-sectional structure shown in FIG. 9 was formed without providing the bend lines B2 to B5 between the bottom portions 2 and 3, and the left and right side wall portions 4, 5, and 6 with the bend-facilitating lines G, the bottom portions 2 and 3 and the left and right side wall portions 4, 5, and 6 were not bent into intended shapes. As a result, the closed cross-sectional structure having a three-dimensionally curved shape could not be formed with high precision.

In contrast, in our example, a closed cross-sectional structure was formed by performing the first step, the second step, and the third step by using dies shown in FIGS. 2 to 5. As a result, the forming operations in all of the first to third steps could be performed, and error in dimensions of a part obtained after performing the third step (deviation from the dimensions of the dies) was as small as ±0.4 mm, and it was confirmed that the part could be formed with high precision.

The invention claimed is:

1. An apparatus that forms a closed cross-sectional structure by bending a plate-shaped workpiece at positions of a plurality of bend lines extending in a longitudinal direction, the structure including a bottom portion formed in a central part of the workpiece in a width direction and left and right side wall portions located on both sides of the bottom portion in the width direction, comprising:

a pressing die including an upper die and a lower die that press-forms the plate-shaped workpiece into a shape including portions corresponding to the bottom portion and the left and right side wall portions such that the plurality of bend lines are formed at boundaries therebetween and to provide bend-facilitating lines at the plurality of bend lines;

a bending die that bends the workpiece, which has been formed using the pressing die, in a direction that the portions corresponding to the left and right side wall portions approach each other by pressing a punch into a space between a pair of dies while clamping the portion corresponding to the bottom portion between the punch and a pad in a plate thickness direction; and a final-closed-cross-section bending die including a plug, a pair of pressure cams and support pad, the plug having an outer peripheral shape the same as a final shape of the closed cross-sectional structure and disposed on the portion of the workpiece corresponding to the bottom portion, which has been formed using the bending die, the support pad supporting the portion of the workpiece corresponding to the bottom portion, the pair of pressure cams being disposed outside of the plug in the width direction, the final-closed-cross-section die bending the portions corresponding to the bottom portion and the left and right side wall portions along the bend-facilitating lines by pressing the portions corresponding to the bottom portion and the left and right side wall portions against an outer periphery of the plug using the support pad and the pair of pressure cams, wherein each of the bend-facilitating lines is a portion of the workpiece where a groove is formed in one surface thereof and a protrusion having a substantially U-shape corresponding to the groove is formed on the other surface thereof, wherein a depth of the groove is greater than or equal to 0.05 times and less than or equal to 0.3 times a plate thickness of the workpiece and wherein a width of the groove is greater than or equal to 0.2 mm and less than or equal to 3.0 mm.

2. The apparatus according to claim 1, wherein the plug is disposed only on end portions in the longitudinal direction of the portion of the workpiece corresponding to the bottom portion.

3. A method of forming a closed cross-sectional structure by bending a plate-shaped workpiece at positions of a plurality of bend lines extending in a longitudinal direction, the structure including a bottom portion formed in a central part of the workpiece in a width direction and left and right side wall portions located on both sides of the bottom portion in the width direction, comprising:

a first step of:

press-forming the plate-shaped workpiece into a shape including portions corresponding to the bottom portion and the left and right side wall portions such that the plurality of bend lines are formed at boundaries therebetween; and providing bend-facilitating lines at the plurality of bend lines;

a second step of bending the workpiece, which has been formed in the first step, in a direction that the portions corresponding to the left and right side wall portions approach each other by pressing a punch into a space between a pair of dies while clamping the portion corresponding to the bottom portion between the punch and a pad in a plate thickness direction; and a third step of bending the portions corresponding to the bottom portion and the left and right side wall portions along the bend-facilitating lines by pressing the portions corresponding to the bottom portion and the left and right side wall portions against an outer periphery of a plug having an outer peripheral shape the same as a final shape of the closed cross-sectional structure while the plug is placed on the portion of the workpiece corresponding to the bottom portion, which has been formed in the second step, wherein each of the bend-facilitating lines is a portion of the workpiece where a groove is formed in one surface thereof and a protrusion having a substantially U-shape corresponding to the groove is formed on the other surface thereof, wherein a depth of the groove is greater than or equal to 0.05 times and less than or equal to 0.3 times a plate thickness of the workpiece and wherein a width of the groove is greater than or equal to 0.2 mm and less than or equal to 3.0 mm.

4. The method according to claim 3, wherein, in the third step, the plug is placed only on end portions in the longitudinal direction of the portion of the workpiece corresponding to the bottom portion.

5. The method according to claim 4, wherein:

the left and right side wall portions of the closed cross-sectional structure rise in a height direction;

in the first step, the plate-shaped workpiece is press-formed such that the portion corresponding to the bottom portion includes a first bottom portion and a second bottom portion that incline in the height direction toward one of the bend lines formed at the boundary therebetween; and in the second step, clamping the portions corresponding to the bottom portion between the punch and the pad makes the first and second bottom portions incline in a direction opposite to the height direction toward the one of the bend lines.

6. The method according to claim 3, wherein:

the left and right side wall portions of the closed cross-sectional structure rise in a height direction;

in the first step, the plate-shaped workpiece is press-formed such that the portion corresponding to the bottom portion includes a first bottom portion and a second bottom portion that incline in a height direction toward one of the bend lines formed at the boundary therebetween; and in the second step, clamping the portions corresponding to the bottom portion between the punch and the pad makes the first and second bottom portions incline in a direction opposite to the height direction toward the one of the bend lines.

* * * * *